US010753007B2

(12) United States Patent
Vazhenin et al.

(10) Patent No.: US 10,753,007 B2
(45) Date of Patent: Aug. 25, 2020

(54) PROCESS FOR INDIUM OR INDIUM ALLOY DEPOSITION AND ARTICLE

(71) Applicant: Atotech Deutschland GmbH, Berlin (DE)

(72) Inventors: Grigory Vazhenin, Berlin (DE); Jan Sperling, Berlin (DE); Stefan Pieper, Berlin (DE); Mauro Castellani, Berlin (DE); Andreas Kirbs, Berlin (DE); Dirk Rohde, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 265 days.

(21) Appl. No.: 15/766,016

(22) PCT Filed: Oct. 4, 2016

(86) PCT No.: PCT/EP2016/073631
§ 371 (c)(1),
(2) Date: Apr. 5, 2018

(87) PCT Pub. No.: WO2017/060216
PCT Pub. Date: Apr. 13, 2017

(65) Prior Publication Data

US 2018/0298511 A1 Oct. 18, 2018

(30) Foreign Application Priority Data

Oct. 6, 2015 (EP) ..... 15188618

(51) Int. Cl.
*C25D 5/48* (2006.01)
*C25D 5/12* (2006.01)
(Continued)

(52) U.S. Cl.
CPC ..... *C25D 5/12* (2013.01); *C23C 18/1653* (2013.01); *C23C 28/021* (2013.01); *C25D 3/56* (2013.01);
(Continued)

(58) Field of Classification Search
None
See application file for complete search history.

(56) References Cited

U.S. PATENT DOCUMENTS 2,287,948 A 6/1942 Smart
2,426,624 A 9/1947 Lien
(Continued)

FOREIGN PATENT DOCUMENTS

JP 03100195 4/1991

OTHER PUBLICATIONS

Q. Huang et al.; "Electrodeposition of Indium on Copper for CIS and CIGS Solar Cell Applications", Journal of The Electrochemical Society, vol. 158, No. 2, Jan. 1, 2011, pp. D57-D61.
(Continued)

*Primary Examiner* — Stefanie S Wittenberg
(74) *Attorney, Agent, or Firm* — Renner, Otto, Boisselle & Sklar, LLP

(57) ABSTRACT

The present invention deals with a process for deposition of indium or indium alloys and an article obtained by the process, wherein the process includes the steps i. providing a substrate having at least one metal or metal alloy surface;
ii. depositing a first indium or indium alloy layer on at least one portion of said surface whereby a composed phase layer is formed of a part of the metal or metal alloy surface and a part of the first indium or indium alloy layer;
iii. removing partially or wholly the part of the first indium or indium alloy layer which has not been formed into the composed phase layer;
(Continued)

iv. depositing a second indium or indium alloy layer on the at least one portion of the surface obtained in step iii.

12 Claims, 5 Drawing Sheets

(51) Int. Cl.

| | |
|---|---|
| ***C25D 5/40*** | (2006.01) |
| ***C25D 7/00*** | (2006.01) |
| ***C25F 5/00*** | (2006.01) |
| ***C23C 18/16*** | (2006.01) |
| ***C23C 28/02*** | (2006.01) |
| ***C25D 5/10*** | (2006.01) |
| ***C25D 3/56*** | (2006.01) |

(52) U.S. Cl.
CPC ..... *C25D 5/10* (2013.01); *C25D 5/40* (2013.01); *C25D 5/48* (2013.01); *C25D 7/00* (2013.01); *C25F 5/00* (2013.01)

(56) References Cited

U.S. PATENT DOCUMENTS

| | | | | |
|---|---|---|---|---|
| 2,458,839 | A | 1/1949 | Dyer, Jr. et al. | |
| 2,497,988 | A | 2/1950 | Green et al. | |
| 4,015,949 | A * | 4/1977 | Baker ..... | F16C 33/201 428/653 |
| 5,554,211 | A | 9/1996 | Bokisa et al. | |
| 8,092,667 | B2 | 1/2012 | Aksu et al. | |
| 8,460,533 | B2 | 6/2013 | Szocs et al. | |
| 2009/0188808 | A1 | 7/2009 | Wang et al. | |
| 2013/0270117 | A1 | 10/2013 | Szocs et al. | |
| 2014/0137989 | A1 | 5/2014 | Huang et al. | |

OTHER PUBLICATIONS

Szocs E. et al.; "High-speed indium electrodeposition: Efficient, reliable TIM technology", Electronics Systemintegration Technology Conference, 2008. ESTC 2008. 2nd, IEEE, Piscataway, NJ, USA, Sep. 1, 2008, pp. 347-350.

PCT/EP2016/073631; PCT International Search Report and Written Opinion of the International Searching Authority dated Nov. 15, 2016.

* cited by examiner

4A

4B

5A

5B

PROCESS FOR INDIUM OR INDIUM ALLOY DEPOSITION AND ARTICLE

The present application is a U.S. National Stage Application based on and claiming benefit and priority under 35 U.S.C. § 371 of International Application No. PCT/EP2016/073631, filed 4 Oct. 2016, which in turn claims benefit of and priority to European Application No. 15188618.1 filed 6 Oct. 2015, the entirety of both of which is hereby incorporated herein by reference.

FIELD OF THE INVENTION

The present invention relates to a process for indium or indium alloy deposition and an article obtained by the process. It further relates to the formation of very smooth and glossy indium or indium alloy layers formed and their use in electronic and semiconductor appliances. It particularly relates to interconnections used in electronic and semiconductor industries such as flip chips, tape automated bonding and the like.

BACKGROUND OF THE INVENTION

Indium is a highly desirable metal in numerous industries because of its unique physical properties. For example, it is sufficiently soft such that it readily deforms and fills in microstructures between two mating parts, has a low melting temperature (156° C.) and a high thermal conductivity. Such properties enable indium for various uses in the electronic and related industries.

For example, indium may be used as thermal interface materials (TIMs). TIMs are critical to protect electronic devices such as integrated circuits (IC) and active semiconductor devices, for example, microprocessors, from exceeding their operational temperature limit. They enable bonding of the heat generating device (e.g. a silicon semiconductor) to a heat sink or a heat spreader (e.g. copper and aluminium components) without creating an excessive thermal barrier. The TIM may also be used in the assembly of other components of the heat sink or the heat spreader stack that composes the overall thermal impedance path.

Formation of an efficient thermal path is an important property of TIMs. The thermal path can be described in terms of effective thermal conductivity through the TIM. The effective thermal conductivity of the TIM is primarily due to the integrity of the interface between the TIMs and the heat spreader thermal conductivity as well as the (intrinsic) bulk thermal conductivity of the TIM. A variety of other properties are also important for a TIM depending on the particular application, for example: an ability to relax thermal expansion stresses when joining two materials (also referred to as "compliance"), an ability to form a mechanically sound joint that is stable during thermal cycling, a lack of sensitivity to moisture and temperature changes, manufacturing feasibility and cost.

The electrolytic deposition of indium has been established long ago in the art. There are various technical drawbacks known with electrolytic deposition of indium. Indium readily precipitates from aqueous solutions as hydroxide or oxide over a wide pH range which typically requires the employment of strong chelating agents and/or strongly alkaline or acidic plating baths. U.S. Pat. No. 2,497,988 discloses an electrolytic indium deposition process using cyanide as additive. The use of cyanide is highly undesired due to its toxicity. Alkaline processes employing various chelating agents such as oxalate are reported inter alia in U.S. Pat. Nos. 2,287,948 and 2,426,624. Alkaline media, however, cannot be used in the later stages of printed circuit manufacturing and semiconductors as solder masks and photoresists are labile to such treatments. Acidic indium plating baths are exemplarily taught in U.S. Pat. No. 2,458,839. Still, the deposits formed therewith are inhomogeneous and often have an island-like structure which renders them useless in the submicron regime. However, due to the increased miniaturization demands in today's electronic industries, these processes are not applicable as sub-micron indium or indium alloy layers are required.

To prevent above-mentioned island-like structures, U.S. Pat. No. 8,092,667 teaches a multi-step process. First, an intermediate layer consisting of indium and/or gallium as well as sulphur, selenium or another metal such as copper is formed and then, gallium, indium or alloys thereof are electrolytically deposited on said intermediate layer. Even though the process may provide indium layers as thin as 500 nm, this process is very laborious. The method taught therein requires more than one plating bath which is undesired as it increases process times and lengthens the required production line and consequently, the cost of manufactured components. Also, very smooth and pure indium layers cannot be provided as the required intermediate layer is made of an alloy with other elements.

A process for electrolytic indium deposition on copper is reported in Journal of the Electrochemical Society 2011, volume 158 (2), pages D57-D61. The reported deposition of indium abides the Stranski-Krastanov growth behaviour albeit in a slightly modified way. The process disclosed therein results in a quick formation of an intermetallic layer of up to 50 nm whereon island-like structures consisting of indium are then formed. However, the process described therein does not allow for the formation of smooth submicron indium layers. Indium or indium alloy layer thicknesses ranging from 50 or 100 nm to less than 1 μm or less than 500 nm cannot be provided by the method disclosed. Moreover, the disclosure only addresses copper as substrate but copper as a substrate is rarely used. The electronic industry usually applies barrier layers on top of copper lines or contacts to avert the electromigration of copper. This migration tendency of copper poses a serious risk to the life-time of electronic components.

Hydrogen evolution during electrolytic deposition of indium is another issue associated therewith. Hydrogen evolution should be minimized because hydrogen is a flammable gas and the formation of hydrogen is a competing reaction with the deposition of indium and thus reduces the efficiency of the indium deposition process. U.S. Pat. No. 8,460,533 B2 teaches an indium plating bath using a polymeric hydrogen scavenger. The polymeric hydrogen scavenger is an addition polymer of epichlorohydrin whose use is undesired due to its high toxicity. Also, it is not desired to provide individual bath formulations for each technical problem.

Objective of the Present Invention

It is an objective of the present invention to provide a process for the deposition of smooth indium or indium alloy layers on metal or metal alloys, particularly on nickel and nickel alloys.

It is another objective of the present invention to provide an indium or indium alloy deposition process which improves the appearance of indium or indium alloy layers such as gloss and/or smoothness using a conventional indium or indium alloy plating bath.

It is still another objective of the present invention to provide a sound bonding site for flip chips and solder bumps made of indium or indium alloys.

It is a further objective of the present invention to provide an efficient indium or indium alloy deposition process which overcomes the limitations of the prior art.

SUMMARY OF THE INVENTION

These objections are solved by using the process and the article according to the independent claims. Preferred embodiments are referred to in the dependent claims.

BRIEF DESCRIPTION OF THE FIGURES

FIG. 4A shows the top-view illustration of said nickel surface with an indium deposit formed by a single-step electrolytic plating as is conventionally done in the art; FIG. 4B shows the same sample from a side view.

FIG. 5A shows again the top view, FIG. 5B the respective side view of the nickel surface.

DETAILED DESCRIPTION OF THE INVENTION

The process for deposition of indium or indium alloys according to the invention comprises the steps:

i. providing a substrate having at least one metal or metal alloy surface;
ii. depositing a first indium or indium alloy layer on at least one portion of said surface whereby a composed phase layer is formed of a part of the metal or metal alloy surface and a part of the first indium or indium alloy layer;
iii. removing partially or wholly the part of the first indium or indium alloy layer which has not been formed into the composed phase layer;
iv. depositing a second indium or indium alloy layer on at least a portion of the surface obtained in step iii.

The steps are carried out in the above-given order.

All potentials in this specification are given in reference to the silver/silver chloride electrode with 3 mol/L KCl as electrolyte ($Ag^+|AgCl$). Percentages throughout this specification are weight-percentages (wt.-%) unless stated otherwise. Concentrations given in this specification refer to the volume of the entire solutions unless stated otherwise. The term "deposition" herein is to include the term "plating" which is defined as a deposition process from a plating bath. The term "electrolytic" is sometimes in the art used synonymously in the art as "galvanic" or such processes are sometimes referred to as "electrodeposition". The terms "potential" and "voltage" are used interchangeably herein. Layer thickness values given herein refer to average layer thickness values as obtainable by XRF.

Figure 1:
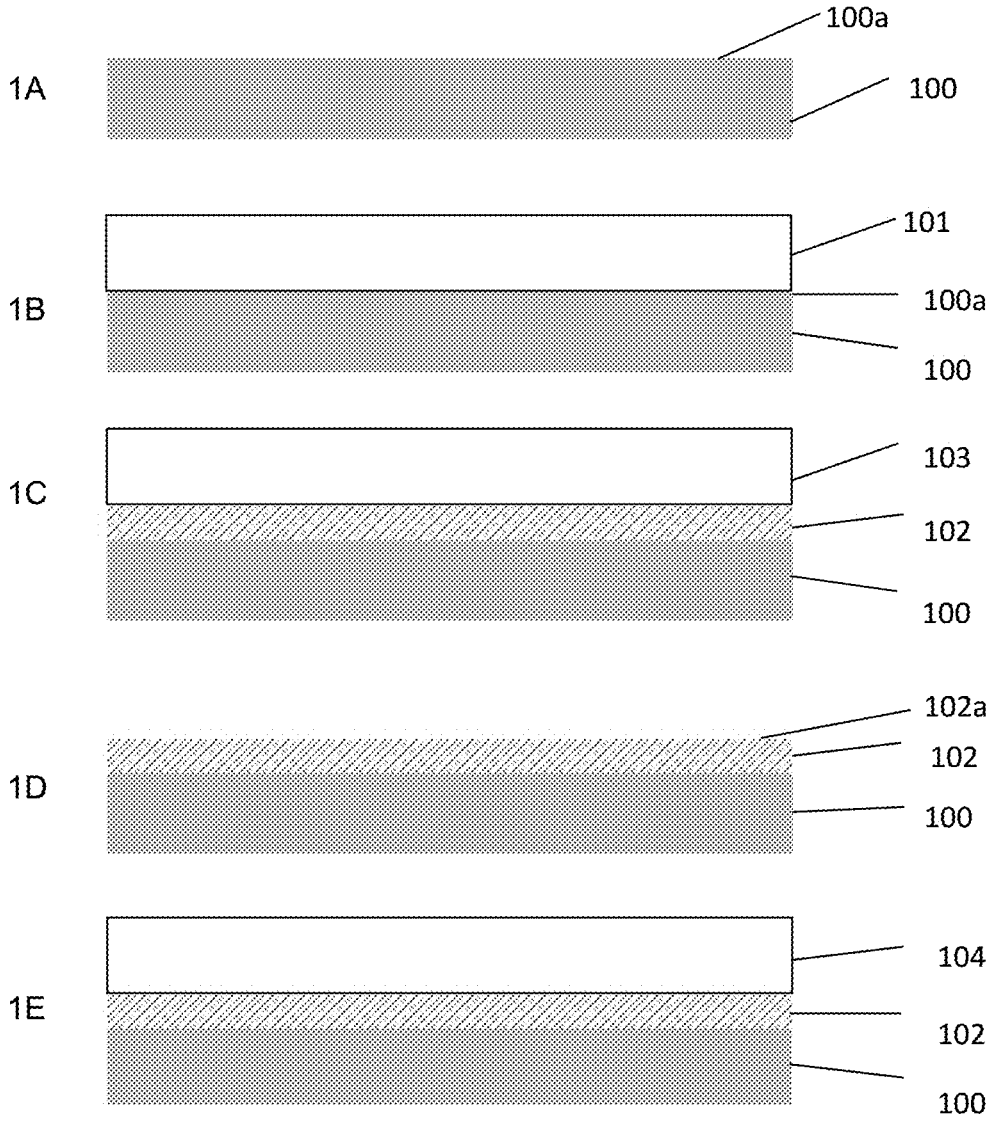
FIG. 1 shows a schematic, non-limiting representation of the process according to the invention.

As shown in FIG. 1A, a substrate (100) having at least one metal or metal alloy surface (100*a*) is provided. Substrates typically used in the present invention are printed circuit boards, wafer substrates, IC (integrated circuit) substrates, chip carriers, circuit carriers, interconnect devices and display devices.

Substrates used in the present invention comprise at least one metal or metal alloy surface. The at least one metal or metal alloy surface is typically an outer layer or an otherwise accessible layer for a deposition process. Therefore, the terms "one metal or metal alloy surface" and "one metal or metal alloy layer" have the same meaning.

The at least one metal or metal alloy surface preferably comprises or consists of one or more than one selected from the group consisting of nickel, aluminium, bismuth, cobalt, copper, gallium, gold, lead, ruthenium, silver, tin, titanium, tantalum, tungsten, zinc and alloys of the aforementioned.

Alloys are meant to include—among others—at least alloys formed by two or more of said metals; alloys of one or more than one of said metals with phosphorous, boron or phosphorous and boron; as well as the respective nitrides and silicides of said metals. Because of the migration tendency of copper and copper alloys, it is more preferred that the at least one metal or metal alloy surface does not consist of copper or an alloy thereof.

The at least one metal or metal alloy surface more preferably comprises or consists of one or more than one selected from the group consisting of nickel, cobalt, ruthenium, titanium, tantalum, tungsten or an alloy of the aforementioned. These metals or metal alloys are typically used as barrier layers in semiconductor and electronics industries on copper lines or contacts to prevent thermomigration or electromigration of copper from copper lines and contacts.

The at least one metal or metal alloy surface used in the present invention most preferably comprises or consists of nickel or one of the following nickel alloys selected from the group consisting of nickel phosphorous alloy, nickel boron alloy, nickel tungsten phosphorous alloy, nickel tungsten boron alloy, nickel tungsten phosphorous boron alloy, nickel molybdenum phosphorous alloys, nickel molybdenum boron alloy, nickel molybdenum phosphorous boron alloy, nickel manganese phosphorous alloy, nickel manganese boron alloy and nickel manganese phosphorous boron alloy. Above-outlined preferences are inter alia due to the fact that the preferred metals and metal alloys show an increased effect of the process according to the invention.

A metal surface in this context such as a nickel surface means a pure metal surface (disregarding any trace impurities commonly present in technical raw materials). Pure metal surfaces usually comprise at least 99 wt.-% of the respective metal. Above-mentioned alloys comprise typically more than 95 wt.-% of said elements forming the alloy, preferably more than 99 wt.-%.

The process according to the invention optionally comprises the further step i.a. pretreatment of the at least one metal or metal alloy surface.

Pre-treatment of metal or metal alloy surfaces is known in the art. Such pretreatment encompasses, but is not limited to, cleaning and etching.

Cleaning steps use aqueous solutions which may be acidic or alkaline which optionally comprise surfactants and/or co-solvents such as glycols. Etching steps mostly employ mildly oxidising acidic solutions such as 1 mol/L sulphuric acid in conjunction with oxidising agents like hydrogen peroxide. Such etching steps are used inter alia to remove oxide layers or organic residues on metal or metal alloy surfaces.

The optional step i.a. is included in the process according to the invention between steps i. and ii.

The process according to the invention optionally comprises the step determination of the open circuit potential.

The open circuit potential is the potential of the working electrode relative to the reference electrode when no potential or current is being applied to the cell.

It is useful to determine the open circuit potential (OCP) as it is dependent on various factors such as the exact composition of the indium or indium alloy plating bath, the metal or metal alloy surface, the pH of the indium or indium alloy plating bath and the temperature of the indium or indium alloy plating bath.

The open circuit potential can be determined by standard analytical means known to those skilled in the art. Useful analytical tools are cyclovoltammetric and linear voltammetric processes. The open circuit potential is the intersection point of the current-voltage-curve with the potential curve. The open circuit potential is inter alia defined in C. G. Zoski, "Handbook of Electrochemistry", Elsevier, Oxford, 1st edition, 2007, page 4. Alternatively, the open circuit potential can be defined and obtained as described in K. B. Oldham, J. C. Myland, "Fundamentals of Electrochemical Science", Academic Press, San Diego, 1st edition, 1994, pages 68-69.

It is advantageous to determine the open circuit potential because ideal potential values for the deposition and removal of indium or indium alloys can then be chosen rendering the overall process more efficient. If the open circuit potential is known for a given process sequence, it is not necessary to determine it anew. This means, that if a process has once been run, it is not required to determine the open circuit potential again (provided that similar or identical conditions are applied).

The determination of the open circuit potential can be used in the process according to the invention between steps i. and ii. and/or between steps ii. and iii. and/or between steps iii. and iv. and/or between steps iv. and steps v. and/or between steps v. and vi. It is typically sufficient and thus preferable to use the step of determining the open circuit potential between i. and ii. and/or between steps ii. and iii.

During determination of the open circuit potential a current-voltage-curve (also referred to as current-versus-voltage-curve) can be obtained.

In step ii., a first indium or indium alloy layer is deposited on at least a portion of the metal or metal alloy surface provided in step i. This is illustrated in FIG. 1B. The substrate (100) having at least one metal or metal alloy surface (100*a*) is depicted with the first indium or indium alloy layer (101) on said surface.

By depositing the first indium or indium alloy layer on at least one portion of the metal or metal alloy surface, a composed phase layer is formed. This composed phase layer is formed of a part of the metal or metal alloy of the surface and a part of the first indium or indium alloy layer deposited thereon. The composed phase layer may be an intermetallic phase, a physical mixture of said components or a combination thereof. Preferably, the composed phase layer is or at least comprises an intermetallic phase of the deposited indium or indium alloy and the metal or metal alloy surface whereon indium or indium alloy is deposited. The composed phase layer such as the intermetallic phase forms at the phase boundary of the deposited first indium or indium alloy layer and the metal or metal alloy of said surface, typically by diffusion of one or more of said materials into the other. The composed phase layer comprises at least indium and the metal or metal alloy of the metal or metal alloy surface. The composed phase layer optionally comprises the second source of reducible metal ions (in its respective metallic form) if an indium alloy is deposited.

The composed phase layer formed of indium or indium alloy and the metal or metal alloy surface forms instantly during the deposition of the first indium or indium alloy layer on at least a portion of the metal or metal alloy surface and thereafter. This is shown in FIG. 1C. The substrate (100) having at least one metal or metal alloy surface (100*a*) is depicted with the composed phase layer (102) in-between the part of the first indium or indium alloy layer (103) and part of the metal or metal alloy which have not been converted/formed into the composed phase layer.

The formation rate of the composed phase layer depends inter alia on the metal or metal alloy surface used in the process according to the invention. In case of barrier layers such as those made of nickel or nickel alloys, electrochemical experiments strongly suggest the formation of an intermetallic phase. This was entirely unexpected because it is known that nickel and nickel alloys are barrier layers with very low migration tendency and that for example nickel and indium do not form intermetallic phases when being subjected to conditions (particularly temperatures) as present in the process according to the invention.

Preferably, the layer thickness of the composed phase layer formed of indium or indium alloy and the metal or metal alloy ranges from 0.1 to 100 nm, preferably from 1 to 50 nm.

The combined thickness of the composed phase layer and first indium or indium alloy layer obtained in step ii. preferably ranges from 0.1 to 500 nm, more preferably from 1 to 400 nm and even more preferably from 5 to 350 nm.

It is possible to wait for a certain period of time until the formation of the intermetallic phase slows down or ceases entirely before step iii. of the process according to the invention is carried out.

It was found that the composed phase layer differs significantly in its physical properties from the first indium or indium alloy layer which has not been formed into the composed phase layer and the metal or metal alloy surface. The composed phase layer has sometimes a different colour. The composed phase layer usually can be more glossy and/or smoother than either of the two aforementioned are. These findings suggest that the composed phase layer is often an intermetallic phase.

The deposition of indium or indium alloys in step ii. preferably is performed by an electrolytic indium or indium alloy deposition process. The process according to the invention then comprises the further steps ii.a. to ii.c.

ii.a. Providing an indium or indium alloy plating bath;

ii.b. Contacting the indium or indium alloy plating bath with the metal or metal alloy surface; and ii.c. Applying an electrical current between the substrate and at least one anode and thereby depositing indium or indium alloy on at least a portion of the metal or metal alloy surface of the substrate.

Step ii.a. can be included at any stage in the process according to the invention before step ii.b. Steps ii.b. and ii.c. are included during step ii. in the process according to the invention. Steps ii.c. is normally not started before step ii.b.

For said electrolytic indium or indium alloy deposition process an indium or indium alloy plating bath is provided. Any conventional indium or indium alloy plating bath may be used. Useful indium or indium alloy plating baths can be found in U.S. Pat. Nos. 2,458,839, 8,460,533 and EP 2245216.

Typically, the indium or indium alloy plating bath comprises at least one source of indium ions and at least one acid and optionally further components selected from at least one source of halide ions, at least one surfactant, at least one chelating agent for indium ions, at least one leveler, at least one carrier, at least one brightener and at least one second source of reducible metal ions.

It is known to those skilled in the art that the properties of any layer deposited from a plating bath depend inter alia on the additives in the plating bath. Thence, the person skilled in the art would select suitable additives to improve the properties from the disclosure herein. The process according to the invention results in an improved smoothness and/or gloss of indium or indium alloy layers for a given indium or indium alloy plating bath.

The indium or indium alloy plating bath is an aqueous solution. The term "aqueous solution" means that the prevailing liquid medium, which is the solvent in the solution, is water. Further liquids, that are miscible with water, as for example alcohols and other polar organic liquids, that are miscible with water, may be added.

The indium or indium alloy plating bath may be prepared by dissolving all components in aqueous liquid medium, preferably in water.

The indium or indium alloy plating bath comprises at least one source of indium ions. Suitable sources of indium ions are water-soluble indium salts and water-soluble indium complexes. Such sources of indium ions include, but are not limited to, indium salts of alkane sulphonic acids such as methanesulphonic acid, ethanesulphonic acid, butane sulphonic acid; indium salts of aromatic sulphonic acids such as benzenesulphonic acid and toluenesulphonic acid; salts of sulphamic acid; sulphate salts; chloride and bromide salts of indium; nitrate salts; hydroxide salts; indium oxides; fluoroborate salts; indium salts of carboxylic acids such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, hydroxybutyric acid; indium salts of amino acids such as arginine, aspartic acid, asparagine, glutamic acid, glycine, glutamine, leucine, lysine, threonine, isoleucine, and valine. Preferably, the source of indium ions is one or more than one indium salts of sulphuric acid, sulphamic acid, alkane sulphonic acids, aromatic sulphonic acids and carboxylic acids. More preferably, the source of indium ions is one or more than one indium salts of sulphuric acid and alkane sulphonic acids. The concentration of indium ions in the indium or indium alloy plating bath preferably ranges from 2.5 g/L to 100, preferably from 5 to 50 g/L, more preferably from 10 to 30 g/L.

The indium or indium alloy plating bath comprises at least one acid and/or a salt thereof to provide a pH of 7 or less, preferably a pH of −1 or 0 to 3. Such acids include, but are not limited to, alkane sulphonic acids such as methanesulphonic acid, ethanesulphonic acid; aryl sulphonic acids such as benzenesulphonic acid, toluenesulphonic acid; sulphamic acid; sulphuric acid; hydrochloric acid; hydrobromic acid; fluoroboric acid; boric acid; carboxylic acids such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, and hydroxybutyric acid; amino acids such as arginine, aspartic acid, asparagine, glutamic acid, glycine, glutamine, leucine, lysine, threonine, isoleucine and valine. One or more than one corresponding salts of above-mentioned acids also may be used. Typically, one or more than one alkane sulphonic acids, aryl sulphonic acids and carboxylic acids are used as acids or salts thereof. More typically, one or more than one alkane sulphonic acids and aryl sulphonic acids or their corresponding salts are used. The concentration of the one or more than one acid or salts thereof range from 0.1 to 2 mol/L, preferably from 0.2 to 1.5 mol/L, more preferably from 0.3 to 1.25 mol/L.

Alternatively, the indium or indium alloy plating bath is alkaline and has a pH above 7. The indium or indium alloy plating bath then comprises at least one base. Any base can be used as long as it liberates hydroxide ions in the indium or indium alloy plating bath. Suitable bases are alkali hydroxides, alkali carbonates and ammonia. Preferably, the indium or indium alloy plating bath is acidic as this prevents solder masks and photoresists from being damaged.

The indium or indium alloy plating bath optionally comprises at least one source of halide ions. Such sources of halide ions are water-soluble halide salts or halide complexes which liberate halide ions in aqueous media. Particularly suitable are alkali halide salts and hydrogen halides. Hydrogen halides can also act as acid and, if used in the indium or indium alloy plating bath, are in respect to their dual-functionality. Chloride ions are preferred. The concentration of halide ions is chosen in dependence of the concentration of indium ions in the indium or indium alloy plating bath. The concentration of halide ions ranges from 1 molar equivalent of halide ions to indium ions to 10 molar equivalents of halide ions to indium ions.

The indium or indium alloy plating bath optionally comprises at least one surfactant. Any surfactant which is compatible with the other components of the compositions may be used. The at least one optional surfactant is selected from non-ionic, cationic, anionic and amphoteric surfactants. Such optional surfactants are included in the indium or indium alloy plating bath in conventional amounts. Preferably, they are included in the indium or indium alloy plating bath in amounts of 0.1 g/L to 20 g/L, preferably from 0.5/L to 10 g/L. They are commercially available and may be prepared from processes disclosed in the literature.

The indium or indium alloy plating bath optionally comprises at least one chelating agent for indium ions. Such chelating agents for indium ions include, but are not limited to, carboxylic acids such as malonic acid and tartaric acid; hydroxy carboxylic acids such as citric acid and malic acid and salts thereof.

Stronger chelating agents for indium ions such as ethylenediamine tetraacetic acid (EDTA) also may be used. The chelating agents for indium ions may be used alone or combinations thereof may be used. For example, varying amounts of a relatively strong chelating agent, such as EDTA can be used in combination with varying amounts of one or more weaker chelating agents such as malonic acid, citric acid, malic acid and tartaric acid to control the amount of indium which is available for electroplating. Chelating agents for indium ions may be used in conventional amounts. Typically, chelating agents for indium ions are used in concentrations of 0.001 mol/L to 3 mol/L.

In accordance with the teachings of U.S. Pat. No. 2,458,839 glucose may be added to improve the throwing power of the indium or indium alloy plating bath and/or the fineness of the indium or indium alloy layer formed.

The indium or indium alloy plating bath optionally comprises at least one leveler. Levelers include, but are not limited to, polyalkylene glycol ethers. Such ethers include, but are not limited to, dimethyl polyethylene glycol ether, di-tertiary butyl polyethylene glycol ether, polyethylene/polypropylene dimethyl ether (mixed or block copolymers), and octyl monomethyl polyalkylene ether (mixed or block copolymer). Such levelers are included in conventional amounts. Typically, such levelers are included in amounts of 100 μg/L to 500 μg/L.

The indium or indium alloy plating bath optionally comprises at least one carrier. Carriers include, but are not limited to, phenanthroline and its derivatives such as 1,10-phenantroline; triethanolamine and its derivatives such as triethanolamine lauryl sulphate; sodium lauryl sulphate and ethoxylated ammonium lauryl sulphate; polyethyleneimine and its derivatives such as hydroxypropylpolyeneimine (HPPEI-200); and alkoxylated polymers. Such carriers are included in the indium or indium alloy plating bath in conventional amounts. Typically, carriers are included in amounts of 200 mg/L to 5000 mg/L.

The indium or indium alloy plating bath optionally comprises at least one brightener. Brighteners include, but are not limited to, 3-(benzthiazolyl-2-thio)-propylsulphonic-acid, 3-mercaptopropan-1-sulphonic acid, ethylendithio-dipropylsulphonic-acid, bis-(p-sulphophenyl)-disulphide, bis-(ω-sulphobutyl)-disulphide, bis-(ω-sulphohydroxypropyl)-disulphide, bis-(ω-sulphopropyl)-disulphide, bis-(ω-sulphopropyl)-sulphide, methyl-(ω-sulphopropyl)-disulphide, methyl-(ω-sulphopropyl)-trisulphide, O-ethyl-dithiocarbonic-acid-S-(ω-sulphopropyl)-ester, thioglycol-acid, thiophosphoric-acid-O-ethyl-bis-(w-sulphopropyl)-ester, 3-N, N-dimethylam inodithiocarbamoyl-1-propanesulphonic acid, 3,3'-thiobis(1-propanesulphonic acid), thiophosphoric-acid-tris-(ω-sulphopropyl)-ester and their corresponding salts. Typically, brighteners are included in amounts of 0.01 mg/l to 100 mg/l, preferably from 0.05 mg/l to 10 mg/l.

The indium or indium alloy plating bath optionally comprises at least one second source of reducible metal ions. Reducible metal ions are metal ions which can be reduced under the conditions provided and hence, they are deposited together with indium forming an indium alloy. Such second source of reducible metal ions is preferably selected from the group consisting of aluminum, bismuth, copper, gallium, gold, lead, nickel, silver, tin, tungsten and zinc. More preferably, it is selected from gold, bismuth, silver and tin. The second source of reducible metal ions may be added to the indium or indium alloy plating bath as water-soluble metal salts or water-soluble metal complexes. Such water-soluble metal salts and complexes are well known. Many are commercially available or may be prepared from descriptions in the literature. Water-soluble metal salts and/or complexes are added to the indium or indium alloy plating bath in amounts sufficient to form an indium alloy having 1 wt.-% to 5 wt.-%, or such as from 2 wt.-% to 4 wt.-% of an alloying metal. Typically, water-soluble metal salts are added to the indium compositions in amounts such that the indium alloy has from 1 wt.-% to 3 wt.-% of an alloying metal.

Quantities of alloying metals in amounts of 3 wt.-% or less can improve TIM high temperature corrosion resistance and wetting and bonding to substrates such as silicon chips and, especially, flip chips. Additionally, alloying metals such as silver, bismuth and tin can form low melting point eutectics with indium making them even more useful for solder applications. The at least one second source of reducible metal ions metals is optionally included in the indium compositions in amounts of 0.01 g/L to 15 g/L, or such as 0.1 g/L to 10 g/L, or such as 1 g/L to 5 g/L.

It is preferred that the indium or indium alloy plating bath comprises only indium ions and no other intentionally added reducible metal ions as this facilitates the deposition process (disregarding trace impurities commonly present in technical raw materials). This shall mean in the context of this preferred embodiment of the present invention that 99 wt.-% or more of reducible metal ions are indium ions. This generally facilitates the deposition and stripping processes as the further reducible metal ions may have an influence on the potentials for the individual deposition and stripping steps.

The temperature of the indium or indium alloy plating bath during the process according to the invention ranges from the melting point to the boiling point of the indium or indium alloy plating bath. Typically, from −20° C. to 80° C., preferably from 5 to 50° C., more preferably from 10 to 40° C., even more preferably from 15 to 35° C.

The indium or indium alloy plating bath is preferably agitated during the process according to the invention. Agitation can be provided by gas feeds such as air or inert gases, liquid feeds such as those to replenish components of the indium or indium alloy plating bath, stirring, movement of the at least one substrate or at least one electrode in the indium or indium alloy plating bath or by any other means known in the art.

The metal or metal alloy surface can be contacted with the indium or indium alloy plating bath by any means known in the art. Preferably, it is contacted by dipping the substrate into the indium or indium alloy plating bath to facilitate the process.

The deposition of indium or indium alloy is then performed during step ii.c.

ii.c. applying an electrical current between the substrate and at least one anode.

The electrolytic deposition of indium or indium alloy in step ii. is a potentiostatic indium deposition process using a more cathodic potential than the open circuit potential.

A preferred potential for the electrolytic deposition of indium or indium alloy ranges from −0.8 to −1.4 V, yet even more preferably from −0.85 V to −1.3 V, yet even some more preferably from −0.9 to −1.2 V.

The time for the electrolytic deposition of indium or indium alloy depends on various factors such as the indium or indium alloy plating bath, temperature and potential used for the deposition. The time for the electrolytic deposition of indium or indium alloy preferably ranges from 0.1 to 60 seconds, more preferably from 1 to 45 seconds, even more preferably from 5 to 30 seconds. This duration is sufficient to provide a first indium or indium alloy layer on the metal or metal alloy surface which then instantly results in the formation of a composed phase layer of the deposited indium or indium alloy and the metal or metal alloy surface. Longer plating times (although possible) result in thicker first indium or indium alloy layers which do not result in any beneficial effect but have to be removed in subsequent steps iii. Too long plating times also result in island-like indium or indium alloy structures with high roughness values (unless they are removed in subsequent steps).

Preferably, soluble indium anodes are used in the process according to the invention as they are used to replenish indium ions and thus keep the concentration of said ions at an acceptable level for efficient indium deposition.

Next, in step iii. the part of the first indium or indium alloy layer which has not been formed into the composed phase layer is partially or wholly removed. In FIG. 1D, the entire removal of the first indium or indium alloy layer which has not been formed into the composed phase layer is shown. The substrate (100) having at least one metal or metal alloy surface (not highlighted in this figure) is covered by the composed phase layer (102).

The surface obtained in step iii. (102*a*) is characterised in that it is less rough than the first indium or indium alloy layer (e.g. 103 in FIG. 1C).

The removal of at least a part of the first indium or indium alloy layer which has not been formed into the composed phase layer in step iii. is preferably an electrolytic stripping process. Stripping means in the context of the present invention the electrochemical dissolution of metallic indium or indium alloy of the indium or indium alloy layers transforming it into dissolved indium ions (and possibly other ions if an indium alloy is stripped). The stripping of (at least a part of) the first indium or indium alloy layer which has not been formed into the composed phase layer is a galvanostatic stripping process or a potentiostatic stripping process. Preferably, a potentiostatic stripping process is used because this eliminates the risk of stripping involuntarily the composed phase layer formed in step ii. particularly if an intermetallic phase is formed. It is advantageous that if the composed phase layer formed in step ii. is an intermetallic phase, the risk of involuntarily stripping it, is reduced as the required potential for stripping an intermetallic phase is usually more anodic than the potential required for stripping of indium or indium alloys. This allows for a facilitated process control. It is thus preferable that the composed phase layer is not removed substantially in step iii. of the process. Not substantially removed is understood in the context of the present invention that more than 90 wt.-% of the composed phase layer remain after step iii., more preferably more than 95 wt.-%, yet even more preferably more than 99 wt.-%, most preferred all of the composed phase layer remains after step iii.

It is advantageous that using a potentiostatic stripping process facilitates the process according to the invention and renders the need for strict process control (such as time control) of this step unnecessary.

As was outlined above, the potential required to remove the composed phase layer, especially for an intermetallic phase, has a more anodic potential than the potential required to strip indium.

Typically, the potentiostatic stripping process uses a potential ranging from 0 to −0.6 V, preferably from −0.2 to −0.4 V.

The required time for the stripping process depends on various parameters such as the amount of indium or indium alloy to be removed (i.e. the indium or indium alloy layer thickness) and the applied potential. The time for the electrolytic stripping process preferably ranges from 0.1 seconds until substantially all indium is removed which has not been formed into the composed phase layer.

Substantially all indium means in this context 90 wt.-% or more, preferably 95 wt.-% or more, more preferably 99 wt.-% or more, of indium which has not been formed into the composed phase layer. It is preferred that in step iii., at least 90 wt.-% of indium or indium alloy indium which has not been formed into the composed phase layer is removed; it is more preferred that 95 wt.-% or more of said indium or indium alloy, even more preferably 99 wt.-% or more thereof are removed in step iii. The latter—especially in the cases where intermetallic phases are formed—is accomplished once the anodic current drops (measured by potentiometer). Usually, 0.1 to 60 seconds are sufficient; 1 to 45 seconds are preferably used. More preferably, the time for the electrolytic stripping process ranges from 5 to 30 seconds.

Preferably, less than 40 nm of indium or indium alloy indium which has not been formed into the composed phase layer remain after step iii., more preferably less than 20 nm, even more preferably less than 15 nm, yet even more preferably less than 5 nm, particularly preferably less than 3 nm. Most preferably, all of the indium or indium alloy indium which has not been formed into the composed phase layer is removed during step iii. Next, in step iv., a second indium or indium alloy layer is deposited on at least a portion of the surface obtained in step iii.

This is illustrated in FIG. 1E. The substrate having at least one metal or metal alloy surface is first covered by the composed phase layer (102) and then by the second indium or indium alloy layer (104) which has been formed on the surface obtained in step iii. (which corresponds in this Figure to the surface of the composed phase layer).

The deposition of indium or indium alloy in step iv. is possible by any known means in the art. The deposition of indium or indium alloy in step iv. is carried out by electrolytic deposition, electroless deposition, chemical vapour deposition or physical vapour deposition. Useful electroless indium or indium alloy plating baths are for example disclosed in U.S. Pat. No. 5,554,211 (A).

Preferably, the deposition of the second indium or indium alloy layer in step iv. is performed by electrolytic deposition. This allows for all indium or indium alloy deposition and removal steps of the entire process to be run in a single indium or indium alloy plating bath. It is preferred to run all indium or indium alloy deposition and removal steps of the whole process according to the invention in a single indium or indium alloy plating bath as this renders the overall process more efficient as e.g. it shortens the production line.

In analogy to step ii., step iv. may comprise similar steps iv.a to iv.c which correspond to or are identical with steps ii.a. to ii.c. As stated above, the indium or indium alloy plating bath of steps ii.a and iv.a preferably is the same. Also, the substrate may remain in the indium or indium alloy plating bath for all indium or indium alloy deposition and removal steps (including steps ii. and iv.).

Preferably, the electrolytic deposition of the second indium or indium alloy layer is a potentiostatic deposition process using a more cathodic potential than the open circuit potential.

The preferred potential for the electrolytic deposition of the second indium or indium alloy layer in step iv. ranges from −0.8 to −1.4 V, yet even more preferably from −0.85 V to −1.3 V, yet even some more preferably from −0.9 to −1.2 V.

The time for the electrolytic deposition of the second indium or indium alloy layer in step iv. preferably ranges from 0.1 seconds until the desired thickness of the indium layer has been obtained. It ranges preferably from 1 to 60 seconds, more preferably from 5 to 30 seconds.

In a preferred embodiment of the present invention, the electrolytic deposition of indium or indium alloy in step ii. and step iv. is a potentiostatic indium deposition process using a more cathodic potential than the open circuit potential. More preferably, the potential used for the electrolytic deposition of indium or indium alloy in step ii. and the potential used for the electrolytic deposition of indium or indium alloy in step iv. is the same as this facilitates the process control.

It is optional to include steps v. and vi. into the process according to the invention v. removing partially or wholly the second indium or indium alloy layer;

vi. depositing a third indium or indium alloy on at least a portion surface obtained in step v.

Steps v. and vi. are included into the process after step iv. has been completed. It is also possible within the means of the present invention to repeat steps v. and vi. more than once and thus form a fourth, a fifth or an indium or indium alloy layer of any higher order until the desired thickness of the intermetallic phase and the indium or indium alloy layer has been obtained. It is preferred to remove the second indium or indium alloy layer (or any higher order indium or indium alloy layer) only partially to build up the indium or indium alloy deposit. Partially means that at least 20 wt.-% or 40 wt.-% or 60 wt.-% or 80 wt.-% of the indium or indium alloy deposited in step iv. remain on the modified surface.

The parameters given for step iii. are useful for step v. (or any repetition thereof). Also, the parameters for step iv. can be employed for step vi. (or any repetition thereof).

The combined thickness of the composed phase layer and all indium or indium alloy layers thereon preferably ranges from 1 to 1000 nm, more preferably from 50 to 800 nm, even more preferably from 100 to 500 nm.

It is preferable that the process comprises the following steps which are carried out in the given order i. providing a substrate having at least one metal or metal alloy surface;

i.a. optionally, pre-treatment of the at least one metal or metal alloy surface;

ii. electrolytically depositing a first indium or indium alloy layer on at least a portion of said surface whereby a composed phase layer is formed of a part of the metal or metal alloy of said surface and a part of the first indium or indium alloy layer;

iii. electrolytically stripping partially or wholly the first indium or indium alloy layer which has not been formed into the composed phase layer;

iv. depositing a second indium or indium alloy layer on at least a portion of the surface obtained in step iii.;

v. optionally, electrolytically stripping partially or wholly the second indium or indium alloy indium layer; and vi. optionally, depositing a third indium or indium alloy layer on at least a portion of the surface obtained in step v.

More preferably, the deposition of the second indium or indium alloy layer is an electrolytical deposition of indium or indium alloy in steps iv. This also applies to the formation of any further indium or indium alloy deposition (such as steps. vi. and so forth).

Figure 2:
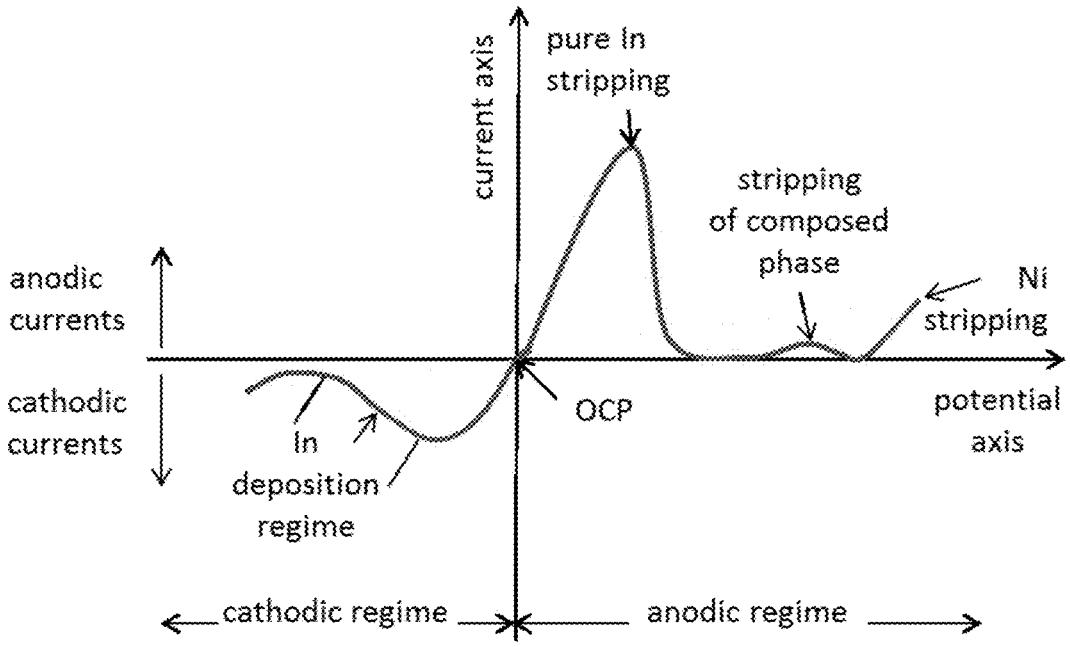
FIG. 2 shows a schematic current-voltage-curve of an indium or indium alloy plating bath.

FIG. 2 shows a schematic current-voltage-curve. In this curve, the preferred potential ranges for the electrolytic indium or indium alloy deposition and its stripping are depicted.

The preferred electrolytic deposition of indium or indium alloy in step ii. and/or step iv. are potentiostatic indium deposition processes using a more cathodic potential than the open circuit potential. Preferably, the employed potential for the electrolytic deposition of indium or indium alloy ranges from the minimum of the current-voltage-curve to the more cathodic inflexion point of the current-voltage-curve or the more cathodic local maximum. The minimum of the curve is more cathodic than the open circuit potential. By choosing a potential in above-defined ranges the formation of hydrogen is minimised rendering the overall process more efficient.

The potential required to remove the composed phase layer, especially the intermetallic phase, has a more anodic potential than the potential required to strip indium. Preferably, a potentiostatic stripping process with a more anodic potential than the open circuit potential is used. The potential for the potentiostatic stripping process more preferably ranges from the open circuit potential to the intersection point (which is more anodic than the open circuit potential) of the current-voltage-curve with the voltage axis or the next local minimum. This preferable range allows for a selective stripping of the indium or indium alloy layer without removing the composed phase layer (or the intermetallic phase) which is required for the deposition of smooth indium layers.

It was found unexpectedly that the deposition of indium or indium alloys on the composed phase layer and particularly on intermetallic phases resulted in smooth indium or indium alloy deposits. The formation of island-like structures can be significantly reduced or entirely prevented (compare Examples 1 and 2). Such smooth indium or indium alloy deposits are useful for a variety of applications, particularly in electronic industries such as flip chip appliances and in the formation of solder connections.

It is an advantage of the present invention that only a single indium or indium alloy plating bath is required to carry out the entire process according to the invention. By changing the potential (and thus the mode of deposition/stripping) the whole process according to the invention can be carried out in a single indium or indium alloy plating bath.

The process according to the invention optionally comprises further rinsing and drying steps. Rinsing is typically done with solvents such as water. Drying can be accomplished by any means known in the art such as the subjecting the substrate to hot air streams or placing them into the hot furnaces.

The process according to the invention is useful to provide a article having at least one metal or metal alloy surface comprising of—in this order— a) the at least one metal or metal alloy surface;

b) a composed phase layer formed of indium or indium alloy and the metal or metal alloy from said surface is formed; and c) one or more than one indium or indium alloy layers are formed by the process according to the invention.

Substrates comprising said layer array are referred to herein as "finished substrates".

Preferably, the finished substrates comprise an intermetallic phase made of indium or indium alloy and the metal or metal alloy from the substrate's metal or metal alloy surface.

The one or more than one indium or indium alloy layers in combination with the composed phase layer in the finished substrates preferably have a thickness of 1 to 1000 nm, more preferably of 50 to 800 nm, even more preferably of 100 to 500 nm. The finished products are manufactured by the process according to the invention.

The following non-limiting examples further illustrate the present invention.

EXAMPLES

General Procedures

As samples Ni-sheets or Ni-plated Brass-sheets were used which were taped with Galvano-Tape (vinyl tape 471, provided by 3M Corp.) to the open area size desired.

The nickel surface of the substrate (referred to as "sample") encompassed an area of 4 $cm^2$. Prior to depositing indium or indium alloy thereon, the samples were cleaned and etched by conventional means, i.e. a degreasing and a soft pickling by 10% HCl. A strong activation of the Ni-surface, as usually done by a Ni-Strike deposition was not necessary in this case since treating the samples in an acidic indium or indium alloy plating bath sufficiently activates the Ni surface. After a final rinse with deionized water, the samples were ready to use.

Electrochemical Analysis (Relates to Step of Determining the Open Circuit Potential)

An Autolab potentiostat (Metrohm) controlled by Nova software was used as a power source for the electrochemical study. Current-versus-voltage curves were recorded using a three electrode setup at a sweep rate of 10 mV/s versus $Ag^+$|AgCl-reference.

Surface Roughness

The topography of indium or indium alloy layers was characterised by means of a white light interferometer (Atos GmbH). The image size for determination of surface roughness had an area of 60×60 μm. The surface roughness was calculated by NanoScope Analysis software. The values inferred from topography data are given to correspond to the average roughness, $S_a$. The surface roughness was measured in the centre of the sample where roughnesses are usually the most distinct.

Layer Thickness

The layer thickness was measured at 5 points of each substrate by XRF using the XRF instrument Fischerscope XDV-SDD (Helmut Fischer GmbH, Germany). By assuming a layered structure of the deposit the layer thickness can be calculated from such XRF data.

Example 1 (Comparative)

An aqueous indium or indium alloy plating bath containing 105 g/L indium sulphate, 150 g/L sodium sulphamate, 26.4 g/L sulphamic acid, 45.8 g/L sodium chloride, 8.0 g/L glucose and 2.3 g/L triethanolamine was prepared by dissolving all components in deionized water.

Figure 3:
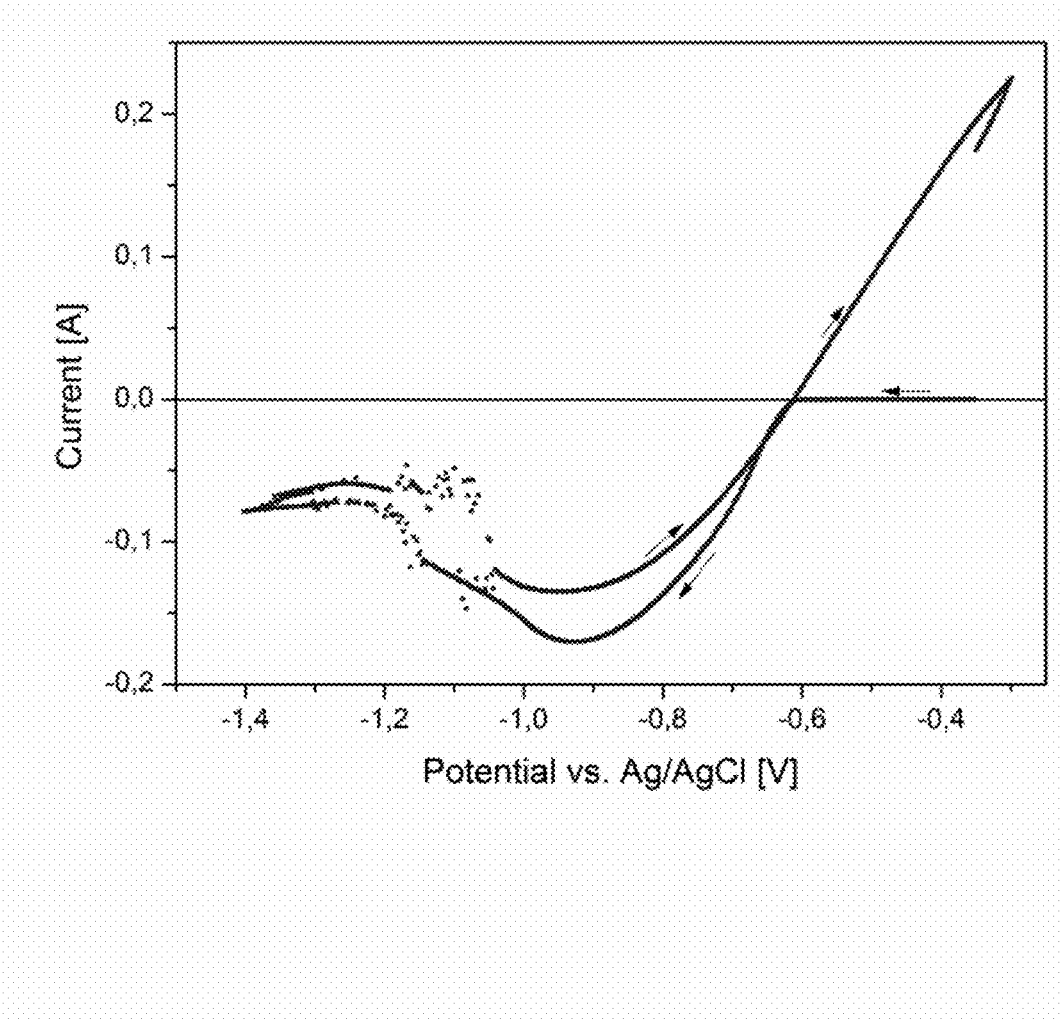
FIG. 3 shows a current-voltage-curve of the indium plating bath used in example 1.

In FIG. 3, a current-voltage-curve of the above-mentioned bath is depicted, when applied directly to the sample. This current-voltage-curve was used to identify a useful working potential for the deposition of indium which was determined to be −1.1 V.

Then, a substrate having a nickel surface (the sample) was immersed into said indium or indium alloy plating bath at 20° C. to deposit indium thereon. The potential for the indium deposition was −1.1 V. The deposition was continued until an electrical charge of 0.55 C/cm$^2$ was applied. The sample was then removed from the indium or indium alloy plating bath, rinsed and dried.

Figure 4:
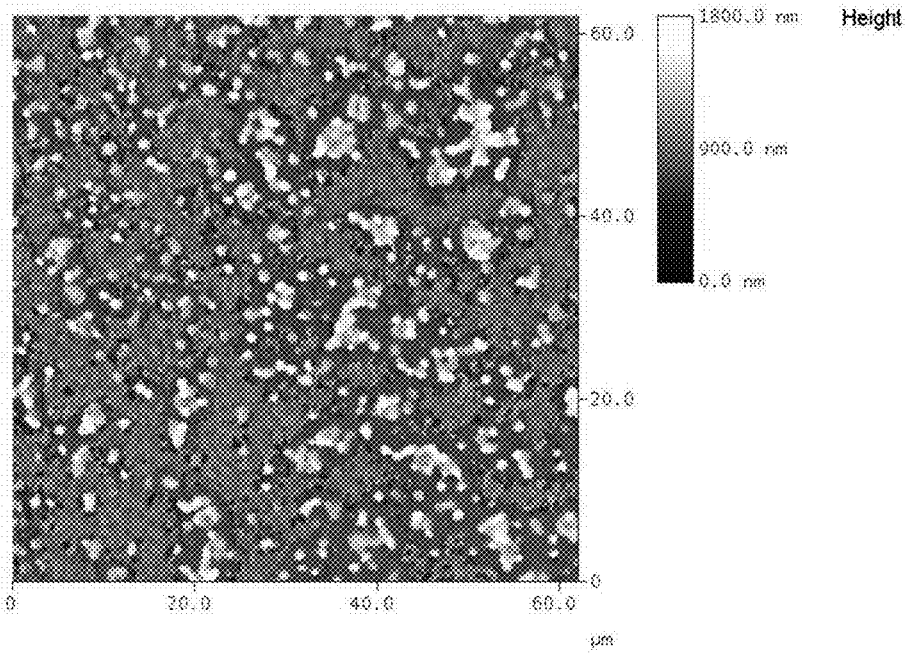
FIG. 4 shows surface topographies of a nickel surface treated with a conventional indium deposition process.
Figure 4:
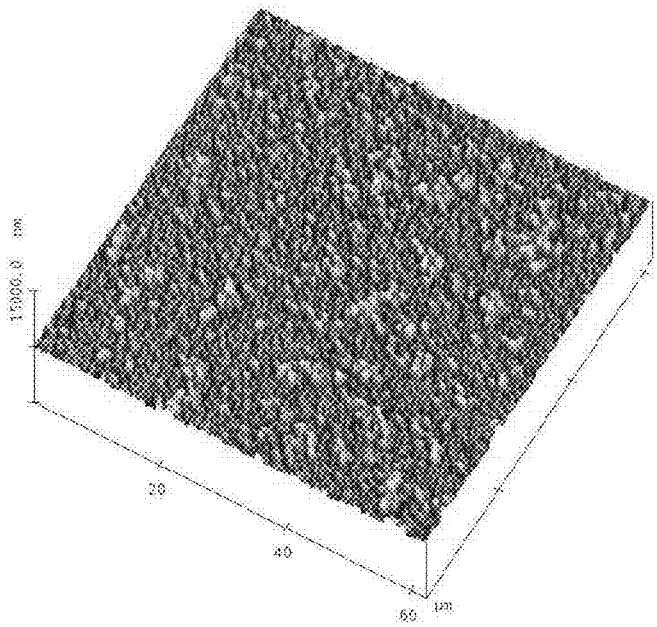
Figure 5:
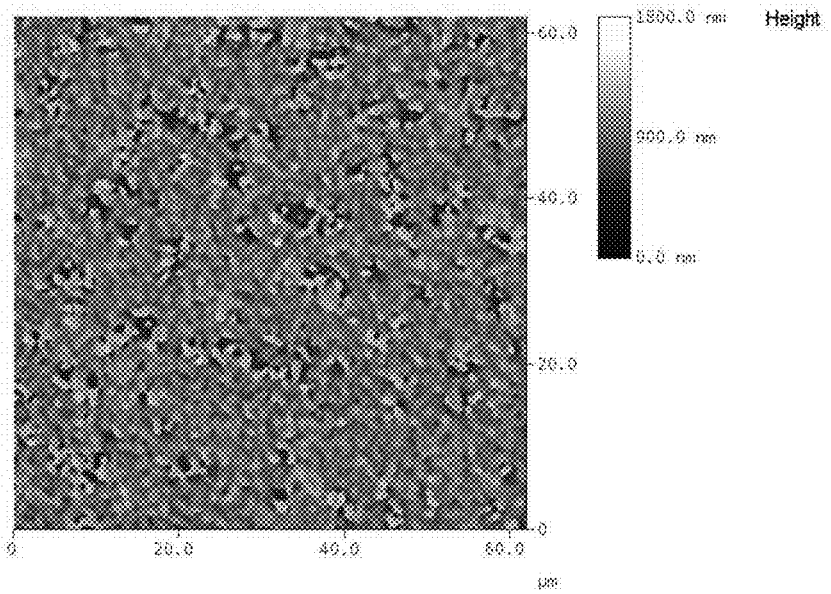
FIG. 5 shows surface topographies of a nickel surface whereon indium was deposited employing the inventive process.
Figure 5:
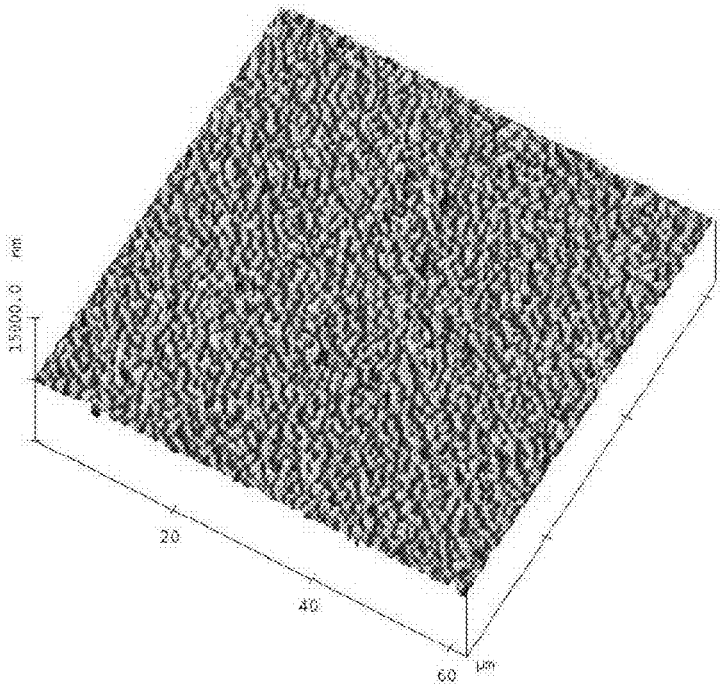

After this indium deposition, the sample was analysed. The surface of the sample had an average roughness of $S_a$=180 nm. The surface had a dull, not glossy appearance. From the surface topography (FIG. 4A), it can be seen that the surface shows island-like structures. There are many indium structures with several hundred nanometres (or even more than 1 μm) in height and many areas where no or much less indium has been deposited.

Example 2 (Inventive)

A substrate having a nickel surface (the sample) was immersed into the indium or indium alloy plating bath of Example 1 at 20° C. to deposit indium thereon. The potential for the indium deposition was −1.1 V (step ii.). After 15 seconds the potential was changed to −0.3 V to strip indium from the composed phase layer (step iii.). As soon as the current became constant which indicated that substantially all of the indium not formed into the composed phase layer was removed, the potential was changed to −1.1 V again. The deposition was continued until a total electrical charge of 0.55 C/cm$^2$ was applied (step iv.). The sample was then removed from the indium or indium alloy plating bath, rinsed and dried.

From the current-voltage-curve depicted in FIG. 3, useful working potentials for the deposition and stripping of indium can be obtained. After this indium deposition, the sample was analysed. From a visual inspection, the surface was much more even and much less dull than the sample surface obtained in comparative Example 1. The surface of the sample had an average roughness of $S_a$=111 nm.

From the surface topography, it can be seen that the surface is much more homogenous than the surface of the comparative example. No island-like structures were obtained because indium was deposited on the composed phase layer.

Example 3 (Comparative)

The process outlined in Example 1 was repeated and indium was deposited on a substrate having a ruthenium surface. A current-voltage-curve was used to identify a useful working potential for the deposition of indium which was determined to be −1.4 V in this case. Otherwise, the same parameters and the same aqueous indium or indium alloy plating bath as given in Example 1 were used. The surface of the sample had an average roughness of $S_a$=75.3 nm and the relative surface area increase (RSAI) was 13.7%.

Example 4 (Inventive)

The process outlined in Example 2 was repeated and indium was deposited on a substrate having a ruthenium surface. A current-voltage-curve was used to identify a useful working potential for the deposition of indium which was determined to be −1.4 V in this case. Otherwise, the same parameters and the same aqueous indium or indium alloy plating bath as given in Example 2 were used. The surface of the sample had an average roughness of $S_a$=49.1 nm and the relative surface area increase (RSAI) was 3.1%.

The average roughness obtained in this inventive Example was around 35% smaller than the value obtained from the respective comparative Example 3.

Example 5 (Comparative)

The process outlined in Example 1 was repeated and indium was deposited on a substrate having a CoWP (cobalt tungsten phosphorous alloy) surface. A current-voltage-curve was used to identify a useful working potential for the deposition of indium which was determined to be −1.2 V in this case. Otherwise, the same parameters and the same aqueous indium or indium alloy plating bath as given in Example 1 were used. The surface of the sample had an average roughness of $S_a$=80 nm.

Example 6 (Inventive)

The process outlined in Example 2 was repeated and indium was deposited on a substrate having a CoWP (cobalt tungsten phosphorous alloy) surface. A current-voltage-curve was used to identify a useful working potential for the deposition of indium which was determined to be −1.2 V in this case. Otherwise, the same parameters and the same aqueous indium or indium alloy plating bath as given in Example 2 were used. The surface of the sample had an average roughness of $S_a$=61 nm.

The average roughness obtained in this inventive Example was around 24% smaller than the value obtained from the respective comparative Example 5.

Example 7 (Comparative)

The process outlined in Example 5 was repeated and indium was deposited on a substrate having a CoWP (cobalt tungsten phosphorous alloy) surface but the working potential for the deposition of indium was set to −1.4 V in this case. Otherwise, the same parameters and the same aqueous indium or indium alloy plating bath as given in Example 5 were used. The surface of the sample had an average roughness of $S_a$=64 nm.

Example 8 (Inventive)

The process outlined in Example 6 was repeated and indium was deposited on a substrate having a CoWP (cobalt tungsten phosphorous alloy) surface but the working potential for the deposition of indium was set to −1.4 V in this case. Otherwise, the same parameters and the same aqueous indium or indium alloy plating bath as given in Example 6 were used. The surface of the sample had an average roughness of $S_a$=39 nm.

The average roughness obtained in this inventive Example was around 39% smaller than the value obtained from the respective comparative Example 7.

Example 9 (Comparative)

The process outlined in Example 1 was repeated and indium was deposited on a substrate having a palladium surface. A current-voltage-curve was used to identify a useful working potential for the deposition of indium which was determined to be −1.2 V in this case. Otherwise, the same parameters and the same aqueous indium or indium alloy plating bath as given in Example 1 were used. The surface of the sample had an average roughness of $S_a$=30.3 nm.

Example 10 (Inventive)

The process outlined in Example 2 was repeated and indium was deposited on a substrate having a palladium surface. A current-voltage-curve was used to identify a useful working potential for the deposition of indium which was determined to be −1.2 V in this case. Otherwise, the same parameters and the same aqueous indium or indium alloy plating bath as given in Example 2 were used. The surface of the sample had an average roughness of $S_a$=28.7 nm. If the working potential was set to be −1.3 V, the average roughness of $S_a$=27.8 nm.

The average roughness obtained in this inventive Example was around 5.5% and 9%, respectively, smaller than the value obtained from the respective comparative Example 9.

Other embodiments of the present invention will be apparent to those skilled in the art from a consideration of this specification or practice of the invention disclosed herein. It is intended that the specification and examples be considered as exemplary only, with the true scope of the invention being defined by the following claims only.

The invention claimed is:

1. A process for deposition of indium or indium alloys comprising the steps i. providing a substrate having at least one metal or metal alloy surface, each said at least one metal or metal alloy surface consisting of one or more than one metal selected from the group consisting of nickel, cobalt, ruthenium or alloys of any of the aforementioned;

ii. depositing a first indium or indium alloy layer on at least one portion of said surface whereby a composed phase layer is formed of a part of the metal or metal alloy surface and a part of the first indium or indium alloy layer;

iii. removing wholly the part of the first indium or indium alloy layer which has not been formed into the composed phase layer, wherein the composed phase layer is not substantially removed in step iii. of the process, wherein more than 90 wt.-% of the composed phase layer remains after step iii.;

iv. depositing a second indium or indium alloy layer on the at least one portion of the surface obtained in step iii.

2. The process according to claim 1 characterised in that the first indium or indium alloy layer in step ii. is formed by electrolytic deposition of indium or indium alloy.

3. The process according to claim 1 characterised in that the deposition of indium or indium alloy in step iv. is carried out by electrolytic deposition, electroless deposition, chemical vapour deposition or physical vapour deposition.

4. The process according to claim 3, characterised in that the deposition of indium or indium alloy in step iv. is an electrolytic deposition of indium or indium alloy.

5. The process according to claim 1 characterised in that the removal of the first indium or indium alloy layer which has not been formed into the composed phase layer is a galvanostatic stripping process or a potentiostatic stripping process.

6. The process according to claim 1 characterised in that the process further comprises the step determination of the open circuit potential.

7. The process according to claim 5 characterised in that a potentiostatic stripping process with a more anodic potential than the open circuit potential is used to remove the first indium or indium alloy layer which has not been formed into the composed phase layer.

8. The process according to claim 7 characterised in that the deposition of indium or indium alloy in step ii. and step iv. is an electrolytic deposition of indium or indium alloy and is a potentiostatic indium deposition process using a more cathodic potential than the open circuit potential.

9. The process according to claim 1 characterised in that the substrates are selected from printed circuit boards, wafer substrates, IC substrates, chip carriers, circuit carriers, interconnect devices and display devices.

10. The process according to claim 1 characterised in that the at least one metal alloy surface is formed by two or more of said metals or of one or more than one of said metals with phosphorous, boron, or phosphorous and boron or of the respective nitrides and silicides of said metals.

11. The process according to claim 1 characterised in that the at least one metal or metal alloy surface consists of nickel or one of the following nickel alloys selected from the group consisting of nickel phosphorous alloy, nickel boron alloy, nickel tungsten phosphorous alloy, nickel tungsten boron alloy, nickel tungsten phosphorous boron alloy, nickel molybdenum phosphorous alloys, nickel molybdenum boron alloy, nickel molybdenum phosphorous boron alloy, nickel manganese phosphorous alloy, nickel manganese boron alloy and nickel manganese phosphorous boron alloy.

12. The process according to claim 1 characterised in that the combined thickness of the composed phase layer and all indium or indium alloy layers thereon ranges from 1 to 1000 nm.

* * * * *